US008258725B2

(12) United States Patent
Ferguson

(10) Patent No.: US 8,258,725 B2
(45) Date of Patent: Sep. 4, 2012

(54) HOLLOW BEAM ELECTRON GUN FOR USE IN A KLYSTRON

(76) Inventor: Patrick Ferguson, Oakland, CA (US)

( * ) Notice: Subject to any disclaimer, the term of this patent is extended or adjusted under 35 U.S.C. 154(b) by 187 days.

(21) Appl. No.: 12/922,430

(22) PCT Filed: Apr. 3, 2008

(86) PCT No.: PCT/US2008/004373

§ 371 (c)(1),
(2), (4) Date: Sep. 13, 2010

(87) PCT Pub. No.: WO2009/123593

PCT Pub. Date: Oct. 8, 2009

(65) Prior Publication Data

US 2011/0006678 A1 Jan. 13, 2011

(51) Int. Cl.
*H01J 23/00* (2006.01)

(52) U.S. Cl. ..... 315/507; 315/500; 315/505; 315/404

(58) Field of Classification Search ..... 315/3.5, 315/5.16, 5.27, 5.28, 5.31, 5.38, 5.39, 5.35, 315/5.51, 15, 16, 404, 500, 505, 507
See application file for complete search history.

(56) References Cited

U.S. PATENT DOCUMENTS

| | | | | |
|---|---|---|---|---|
| 3,258,626 | A | 6/1966 | Kino et al. | |
| 3,315,110 | A * | 4/1967 | Wang | 313/455 |
| 3,688,152 | A | 8/1972 | Heynisch et al. | |
| 3,755,706 | A | 8/1973 | Scott | |
| 3,801,854 | A | 4/1974 | Giebeler | |
| 3,853,600 | A | 12/1974 | Hou | |
| 3,916,246 | A | 10/1975 | Preist | |
| 3,921,027 | A | 11/1975 | Shelton et al. | |
| 4,425,529 | A | 1/1984 | Leboutet | |
| 4,780,647 | A | 10/1988 | Friedman et al. | |
| 4,949,011 | A | 8/1990 | Mann | |
| 5,162,747 | A | 11/1992 | Tammaru | |
| 5,461,282 | A * | 10/1995 | Scheitrum et al. | 315/5.31 |
| 5,698,949 | A * | 12/1997 | Lien et al. | 315/5.31 |
| 6,114,808 | A | 9/2000 | Takahashi | |
| 6,617,791 | B2 * | 9/2003 | Symons | 315/5.38 |
| 6,870,320 | B2 | 3/2005 | Ratzinger et al. | |
| 6,998,783 | B2 * | 2/2006 | Symons | 315/5.37 |
| 7,071,604 | B2 * | 7/2006 | Dayton, Jr. | 313/311 |
| 7,638,946 | B2 * | 12/2009 | Kirshner et al. | 315/3.5 |
| 2004/0174211 | A1 | 9/2004 | Symons | |
| 2007/0146084 | A1 | 6/2007 | Syratchev | |
| 2008/0024065 | A1 | 1/2008 | Yakovlev et al. | |
| 2008/0042073 | A1 | 2/2008 | Kirshner et al. | |

FOREIGN PATENT DOCUMENTS

| | | |
|---|---|---|
| JP | 1173547 A | 7/1989 |
| JP | 5089787 | 4/1993 |

* cited by examiner

*Primary Examiner* — Haiss Philogene
(74) *Attorney, Agent, or Firm* — Dergosits & Noah LLP

(57) ABSTRACT

A klystron has a hollow beam electron gun that has a circular planar electron emitting surface. A hollow electron beam is directed from the electron gun through a plurality of drift tubes, resonant chambers and magnetic fields to a collector. The hollow electron beam does not experience significant radial movement and can operate at a lower beam voltage which reduces the required length of the RF interaction circuit and lowers the risks of RF arcing.

19 Claims, 9 Drawing Sheets

HOLLOW BEAM ELECTRON GUN FOR USE IN A KLYSTRON

FIELD OF INVENTION

The present invention relates generally to hollow beam electron guns used with multiple cavity klystrons. These klystrons can be used for particle accelerators and colliders, power amplifier for radar and directed energy applications.

BACKGROUND OF THE INVENTION

FIG. 1 is a schematic view of a conventional seven-cavity klystron 10. The klystron 10 amplifies RF energy by extracting energy from an electron beam. A plurality of successive drift tubes 30, 31, 32, 33, 34, 35 respectively connect with the seven cavities 16, 17, 18, 19, 20, 21, 22, such that one drift tube interconnects two adjacent cavities. Each cavity is individually tuned, and an electromagnet is placed around the klystron for focusing the electron beam. The electron gun 12 produces an electron beam 11 which is accelerated to a high voltage. Simultaneously, a microwave signal is fed into an RF input port 14 for interacting with the electron beam 11 within an input resonating cavity 16. The electron beam 11, with velocity modulation superposed by the input microwave signal, passes through a sequence of successive gain cavities 17, 18, 19, 20, 21. The velocity modulation of the electron beam is amplified as it passes by each of the gain cavities 17, 18, 19, 20, 21. The velocity modulated electron beam travels to the output cavity 22, where the velocity modulation is converted into amplified microwave output power and is extracted through the RF output port 24. The spent electron beam is absorbed by the collector 26 positioned after the output cavity.

The velocity modulation is also known as bunching which is caused by the oscillating electric fields applied to the drift tubes. As each sequential cavity is encountered, electrons are accelerated during opposing electric fields and pass through the drift tubes 30, 31, 32, 33, 34, 35 and other electrons are slowed during a corresponding electric field. This cycling causes the electrons to be grouped into bunches at the input frequency. The geometries of the cavities 16, 17, 18, 19, 20, 21, 22 along the length of the klystron are designed to enhance the bunching of electrons. The spacing between successive cavities 16, 17, 18, 19, 20, 21, 22 is also intended to optimize the electron bunching and improve the output power of the klystron 10.

Solid electron beam klystrons require a high beam voltage to keep the interaction efficiency high. The circuit length of the klystron is proportional to the electron beam voltage. Thus, a high beam voltage requires a larger klystron having a longer circuit length to keep the interaction efficiency. Another problem with high beam voltage is the increased probability of RF arcing which can damage or destroy a klystron. What is needed is an improved klystron that addresses operation at a lower beam voltage to reduce the required circuit length and reduce the probability of RF arcing.

SUMMARY OF THE INVENTION

The present invention is directed towards a hollow electron beam gun in lieu of a solid beam gun used with a klystron which performs RF power amplification. The electron gun includes a flat cathode that forms a ring around the center axis of the klystron. The cathode has a circular electron emitting surface that can be planar and substantially perpendicular to the center axis. A ring anode is separated from the flat cathode by a fixed gap. A heater is coupled to the cathode to heat the cathode. At a high temperature of about 1,100° C., the cathode is activated to emit electrons which are accelerated through the center of the ring anode. At this high temperature, the electron gun operates in a space charge limited operation which can be used to produce long pulses or continuous output of electrons that form the hollow electron beam. Focusing electrodes can be positioned adjacent to the inner and outer radius of the cathode. The electrodes are designed to produce a uniform cathode current density.

The hollow electron beam electron gun, mounted at a proximal portion of the klystron, emits a hollow electron beam towards the first cavity of the klystron. The hollow beam may be concentric with the axis of the drift tube and travel through an outer radial region within the drift tubes. For example, the inner radius of the hollow beam may be greater than 70% of the inner radius of the drift tube without any electrons travelling through the center of the drift tube. In the preferred embodiment, the inner and outer radii of the hollow electron beam may be located at about 80% and 90% of the of the drift tube inner radius respectively. Thus, the beam wall thickness of the hollow electron beam may be about 10% of the inner radius of the drift tube.

In contrast, a solid electron beam may have a beam diameter that is about 60% of the inner diameter of the drift tube. Thus, the thickness of the beam cross section and the space occupied by the hollow electron beam are substantially different than the cross section and space occupied by a solid electron beam.

The hollow electron beam travels through the drift tubes and past multiple resonant cavities that are tuned to the operating conditions of the klystron. Any number of drift tubes and resonant cavities can be used in the inventive klystron, however a typical hollow beam klystron may have from 5 to 10 resonant cavities. The first cavity at the proximal portion of the klystron includes an RF input port and the last cavity at the distal portion of the klystron includes an RF output port. A static magnetic field from an electromagnet or, equivalently, a solenoid is applied externally to the klystron to focus the hollow electron beam. The electron interaction depends on the amplitude and polarity of the oscillating electric fields from each cavity as the electron beam progresses through the drift tubes. During the time the electrons are traveling through the drift tubes between cavities, some are accelerated and the remaining are decelerated. This has the effect of forming bunches of electrons that arrive at the output cavity at the proper instant during each cycle of the RF field and deliver energy to the output cavity. Since the hollow electron beam has a thin cross section, the radial component of the cavity electric fields do not cause significant radial movement of the hollow beam electrons. Thus, the hollow electron beam remains in a fairly narrow radial oscillation envelope as the electron beam travels through the drift tubes and is absorbed by the collector.

The length of the klystron is proportional to the voltage applied to the electron beam, so a high voltage electron beam will have a longer circuit length than a system using a lower voltage electron beam. This relationship is true for both hollow and solid electron beam klystrons. However, a solid beam klystron will have a longer circuit length than a hollow beam klystron because solid beam klystron must operate at a higher electron beam voltage in order to have the same efficiency. For solid electron beam klystrons, the efficiency is inversely proportional to the "Perveance" which is defined as $K=31.62\times I/V^{3/2}$, where I is the beam current in amperes and V is the beam voltage in kilovolts. If the voltage is decreased, the perveance will increase and the efficiency is reduced. Thus, a high beam voltage is generally a requirement of an efficient sold electron beam klystron.

In contrast, the efficiency of the hollow electron beam klystron is substantially independent of perveance. A hollow electron beam klystron can operate at a lower beam voltage and a high perveance without decreasing the system efficiency. Since the hollow electron beam operates at a lower electron beam voltage than a solid electron beam, the hollow beam klystron has a shorter RF interaction circuit length. A shorter klystron is less expensive to build and easier to install at customer sites. The lower beam voltage also reduces the risk of RF arcing.

The inventive hollow electron beam klystron can replace directly solid beam klystrons with a large reduction in electron beam voltage, multiple beam klystrons where there are more than 6 cathodes and the cascade arrangements of multiple vacuum triodes in a common narrow band resonating cavity.

BRIEF DESCRIPTION OF THE DRAWINGS

The present invention will be best understood, by reference to the following description and the accompanying drawings, wherein.

DETAILED DESCRIPTION

The following is a list of terms important to understanding the Klystron of the present invention. Each of the terms is followed by its corresponding definition as used herein.

Glossary of Terms

- Anode—positively charged electrode that accelerates the electron beam
- Bunching—grouping of electrons within the klystron in response to the frequency of the oscillating electric fields leaking into the connecting drift tubes from each cavity
- Cathode—negatively charged electrode that emits the electron beam
- Collector—a chamber that traps the electrons from the electron beam at the end of the klystron
- Drift Tube—a straight cylinder connecting adjacent cavities through which the electron beam propagates
- Focusing Electrode—circular electrode located adjacent to the cathode to control the shape and emission of the electron beam
- Magnetic Coil—one of many coils that are located in the solenoid to provide the constant axial magnetic field for focusing the electron beam
- Resonant Cavities—cylindrical shaped geometrical configurations resonating about the center frequency of the klystron—located between the individual drift tubes
- Thermionic Emission—electron emission that occurs when the cathode is heated above the material work function.

Figure 1:
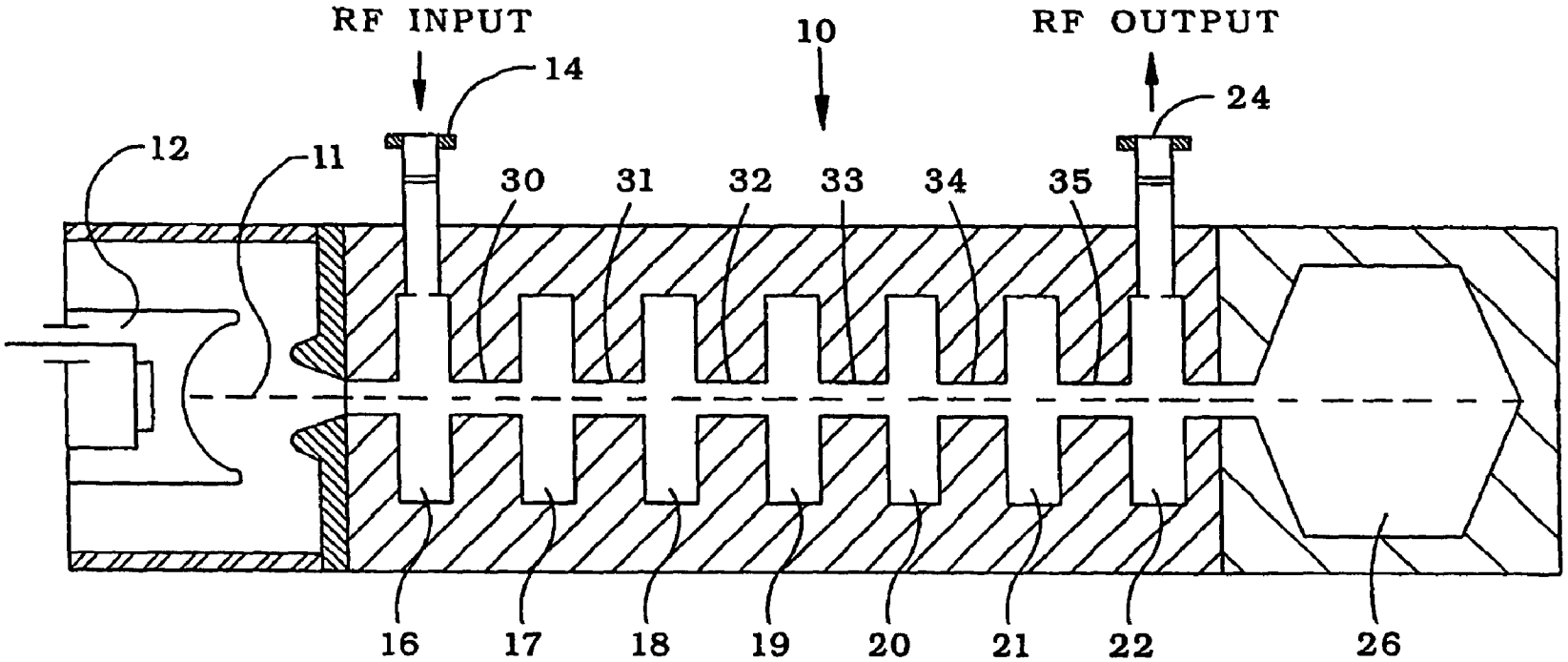
FIG. 1 (PRIOR ART)
FIG. 1 is a cross sectional view of a prior art seven cavity klystron (prior art)
Figure 2:
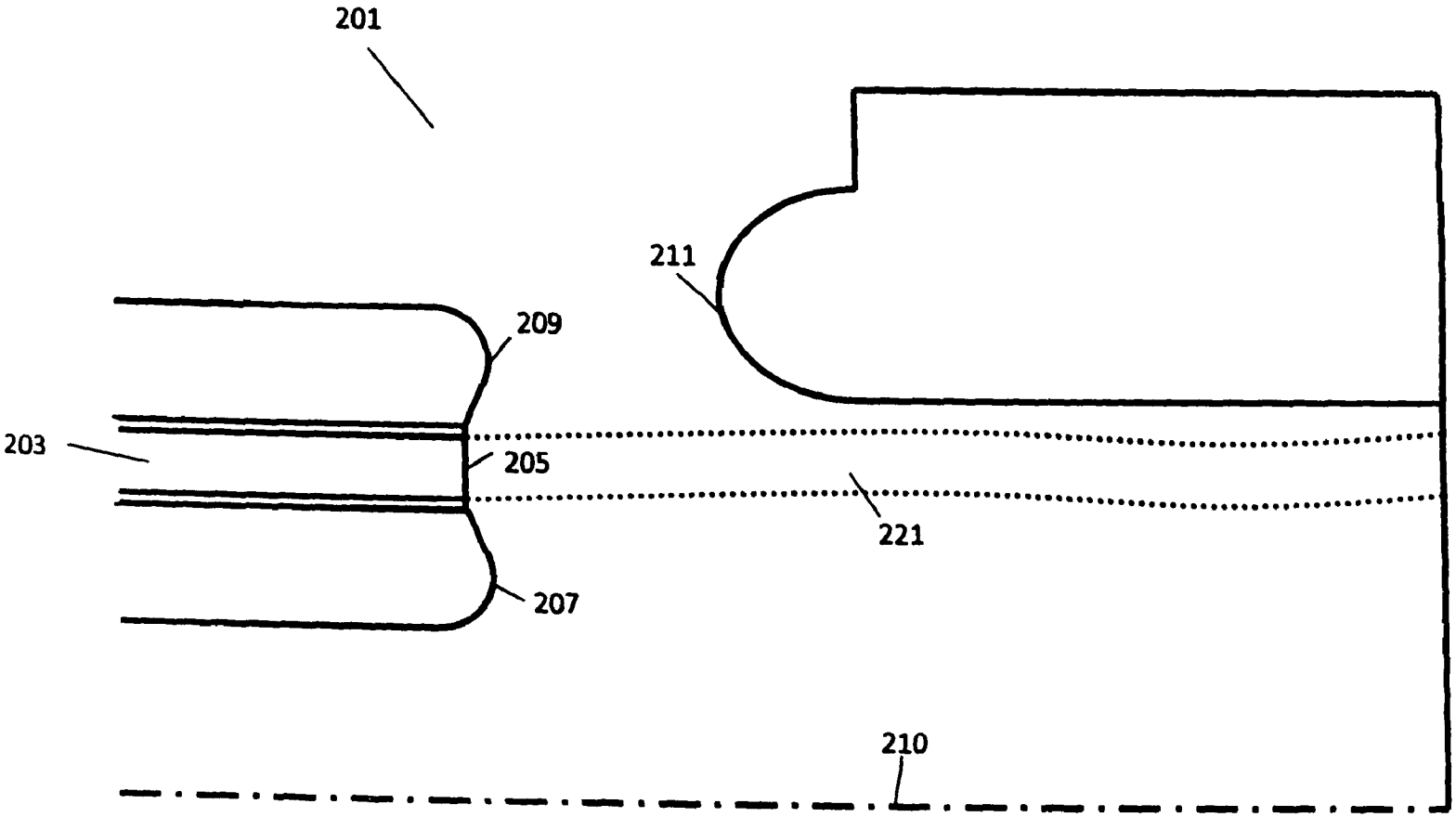
FIG. 2 is a half cross sectional view of a hollow beam electron gun.
Figure 3:
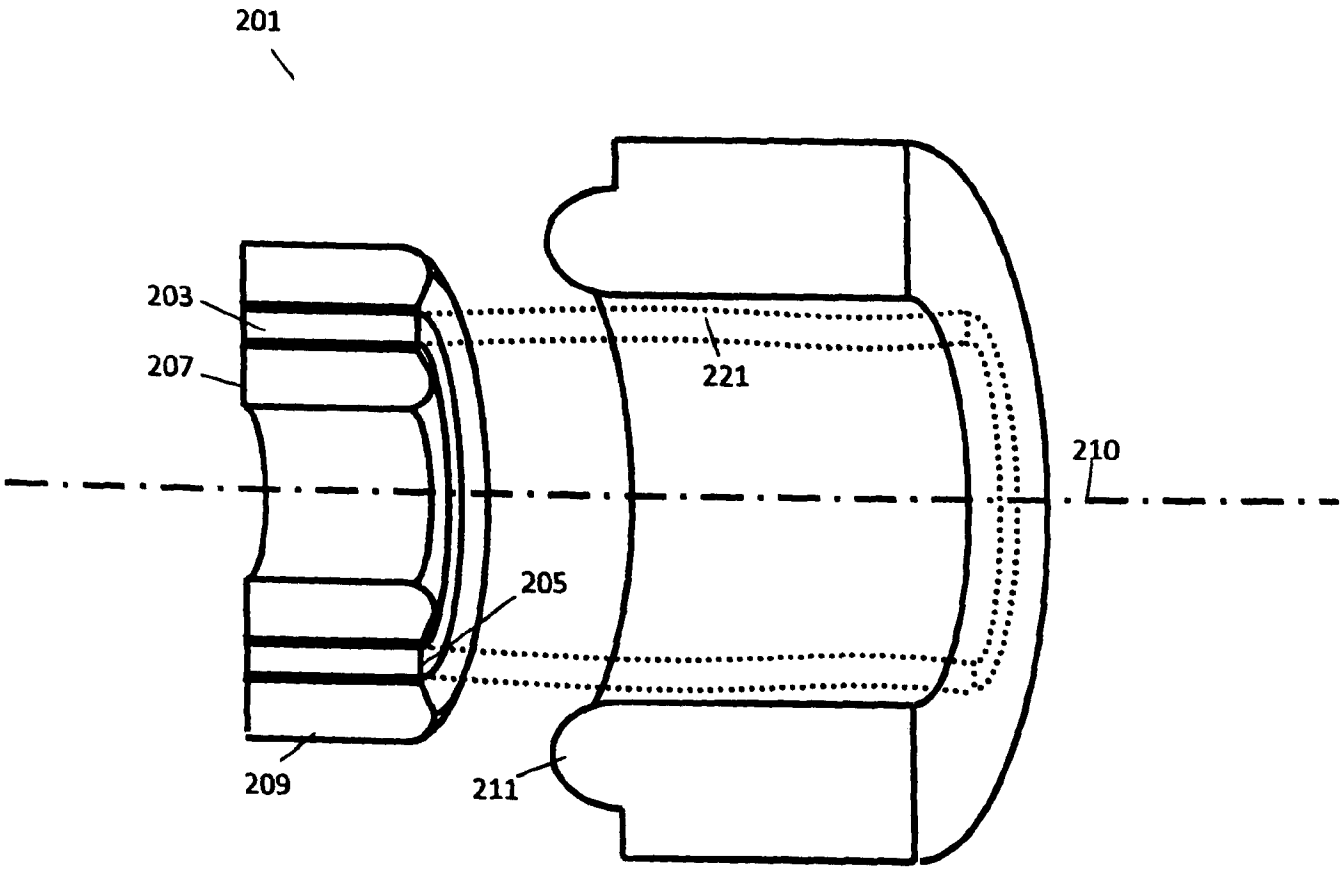
FIG. 3 is a cross sectional perspective view of a hollow beam electron gun.

The present invention is directed towards an improved klystron which includes a special hollow electron beam gun that is used to generate a hollow electron beam. With reference to FIG. 2, a cross section of an embodiment of a hollow beam electron gun 201 is illustrated that generates a hollow electron beam. FIG. 2 is a half cross sectional view because only the upper half of the hollow beam electron gun 201 is illustrated. The lower edge represents the center axis 210 of the electron gun. FIG. 3 illustrates a full cross sectional view of the hollow beam gun that includes the upper and lower portions of the hollow beam electron gun 201 with the center axis extending through the vertical center. The electron gun 201 includes a cathode 203 having an electron emitting surface 205, an inner focusing electrode 207, an outer focusing electrode 209 and an anode 211.

The cathode 203 is heated by a heater (not shown) until thermionic emission of electrons from the electron emitting surface 205 occurs. In a preferred embodiment, the thermionic emission of the cathode is in a space charge limited region. The heating element can be a high resistive wire that is embedded in an insulated annular structure that is mounted within the ring cathode. The electron gun 201 and interior volume of the klystron are placed in a vacuum and electrical power applied to the heating element raises the temperature of the cathode 203 above the work function of the cathode material resulting in space charge limited emission of electrons. The electrons are emitted from the cathode surface 205.

The anode 211 is an annular electrode that is positively charged and mounted away from the cathode 203 by a fixed gap, the gap length being depended upon the design perveance of the klystron. The anode 211 is concentric with the cathode 203 about the center axis 210 and the inner diameter of the anode 211 is larger than the outer diameter of the electron emitting surface 205 of the cathode 203. A high voltage, pulse or constant in time, is applied across the cathode 203 and anode 211 that causes the electrons emitted by the cathode 203 to be attracted to the anode 211 in a hollow electron beam 221. The hollow electron beam passes through the orifice of the anode 211 into the first drift tube of the klystron. Although there is a slight movement of the electron beam diameter 221 in the radial direction resulting in slight variations to the electron beam 221 diameter, the hollow electron beam 221 will remain in a fairly small radial oscillation envelope. Thus, the hollow beam 221 emitted by the circular electron emitting surface 205 of the cathode 203 remains in substantially the same cross section through the length of the klystron. Almost all of the electron beam 221 movement is from the axial components of the magnetic fields which results in movement and bunching of the electron beam 221 in the axial direction.

Figure 4:
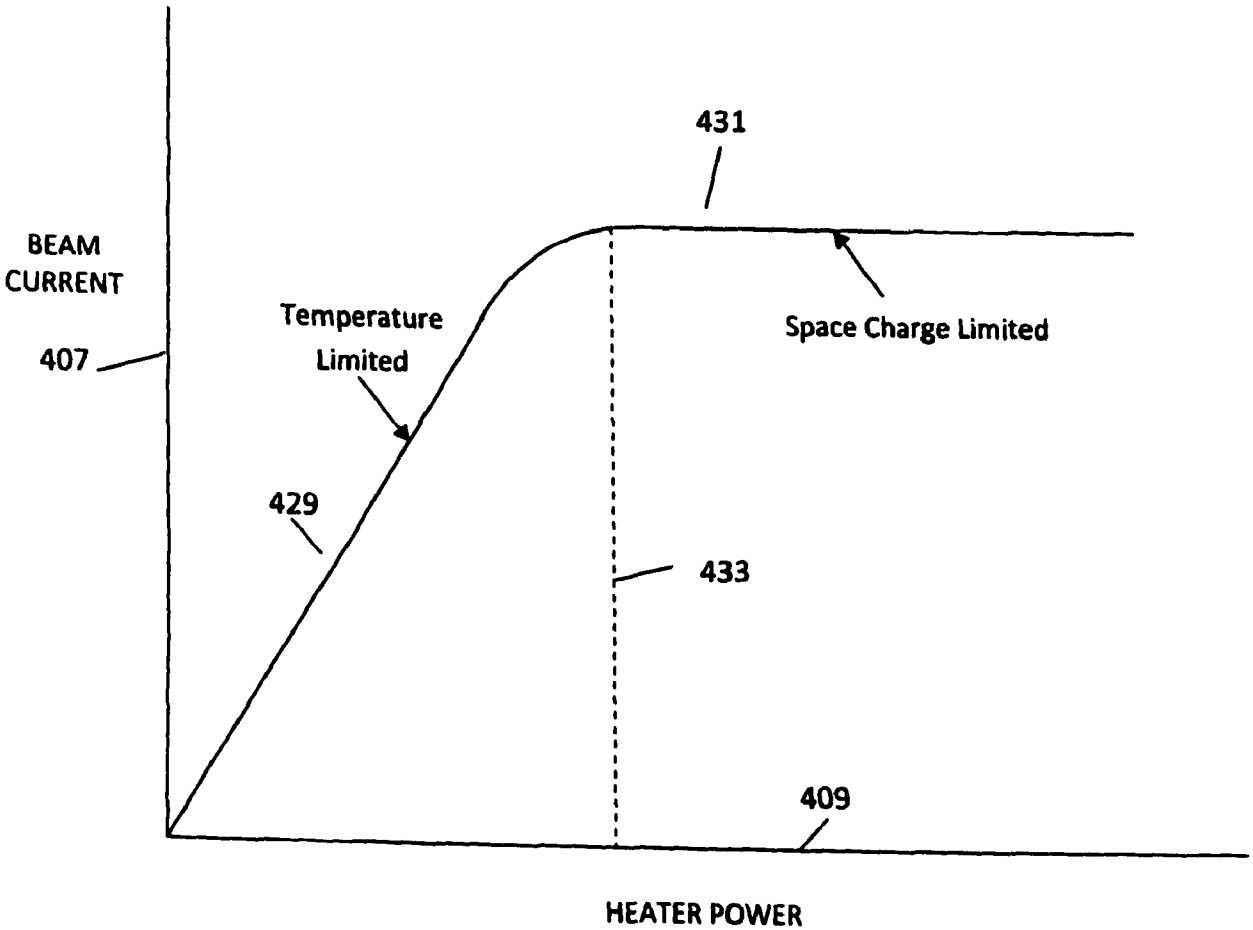
FIG. 4 is a graph illustrating the relationship between beam current and heater power.

A benefit of the cathode 203 of the inventive hollow beam electron gun 201 is that it operates in the "space charge limited" region in which excess electric charge is a continuum of charge distributed over a region of space. With reference to FIG. 4, a graph illustrating the relationship between beam current 407 and heater power 409 is shown. At lower beam current 407 and heater power 409 there is a linear relationship. This linear section is known as the "temperature limited" 429 region. As the heater power 409 continues to increase, a maximum beam current 407 is reached such that the electron emission and beam current 407 remains steady even as the heater power 409 is increased. The peak beam current section of the graph is the space charge limited 431 region.

In the preferred embodiment, the inventive electron gun 201 operates in the space charge limited region 431 and produces a steady stream of electrons which results in a steady beam current 407, constant RF power output and constant efficiency from the klystron. In contrast, earlier hollow beam devices employed an electron gun configuration referred to as a magnetron injection gun or MIG. The MIG incorporates a conical section cathode where the smaller diameter of the conical section is closer to the klystron circuit than the larger diameter. This results in electron mission with a large radial velocity component. The two disadvantages to the MIG is that the emission must be temperature limited 429 and the axial magnetic focusing field must be large to suppress the radial energy in the electron beam. Being temperature limited results in a variation of RF output power because the emission decreases substantially when the pulse length of the electron beam voltage is long. Also as a result of the large radial velocity of the electron beam, complete suppression cannot be obtained and therefore the interaction efficiency, being completely dependent on the axial energy in the electron beam, is reduced. Since a constant klystron output power is preferred, a hollow beam electron gun that operates in the space charge limited region is preferred over an electron source operating in the temperature limited region.

Figure 5:
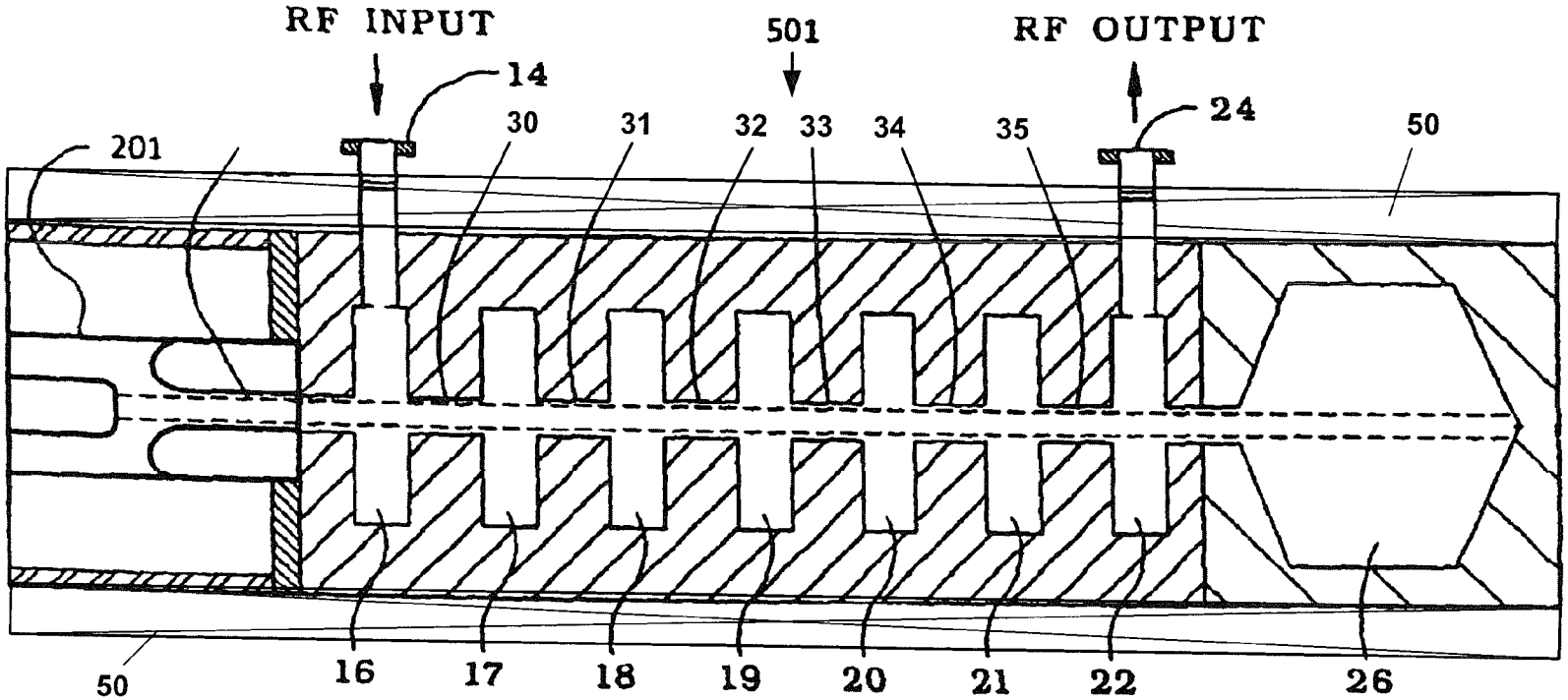
FIG. 5 is a cross sectional view of a seven cavity hollow beam klystron.

With reference to FIG. 5, a cross sectional view of an embodiment of a hollow beam klystron 501 is illustrated. The electron gun 201 described above directs a hollow electron beam 511 into a seven cavity interaction circuit. The electron gun 201 includes the flat cathode (shown in FIGS. 2 and 3) that emits a hollow electron beam 511 that is excited by the electric fields applied to the electron beam which causes bunching of electrons traveling through the klystron. An RF signal is applied to the input port 14 into the first cavity 16 of the klystron 501 and is amplified as it travels through the drift tubes 30, 31, 32, 33, 34, 34 and traverses the cavities 16, 17, 18, 19, 20, 21. The amplified RF signal is extracted from the final cavity 22 through a wave guide. The hollow electron beam 511 continues through the klystron into the collector 26. A static magnetic field from a solenoid 50 is applied externally to the klystron 501 to focus the hollow electron beam 511.

Figure 6:
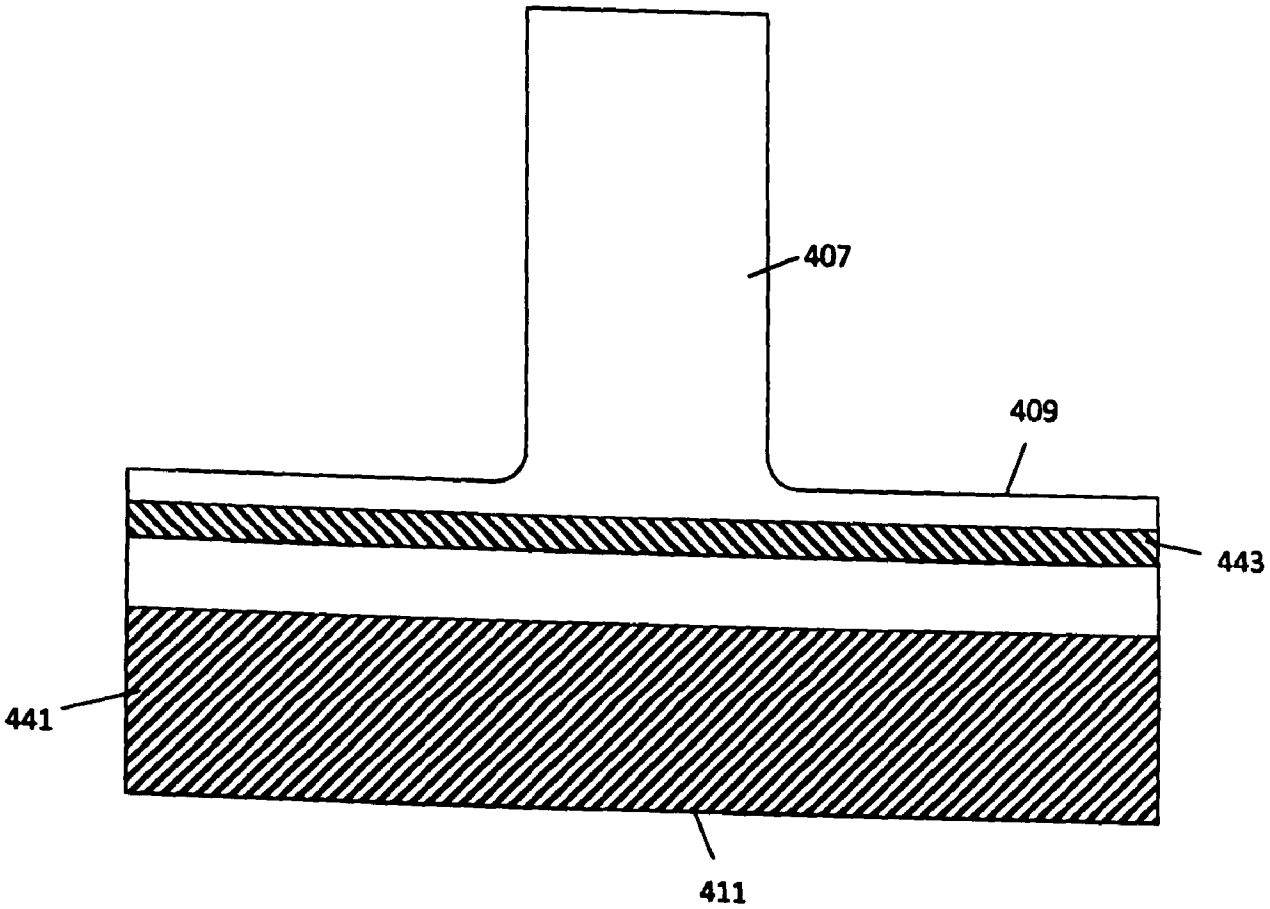
FIG. 6 is a half sectional view of a pillbox shaped cavity with an input and output drift tube.

FIG. 6 is a half sectional view of a resonating cavity 407 and drift tube 409 with the location of the solid electron beam 441 and the location of the hollow electron beam 443 illustrated for comparison. The cavity is symmetric about the axis of rotation 411 of the klystron and the lower edge represents the axis of a drift tube. The drift tube 409 can be divided into ten concentric cylinders each representing a 10% increment in radius between the center of the drift tube and the inner diameter. The distance between the center axis 411 and the outer edge 409 represents 100% of the radius of the drift tube. In a preferred embodiment, the hollow electron beam occupies the annular volume between the radii representing 80% and 90% of the total drift tube 409 radius. In contrast, a solid electron beam klystron may typically use a solid beam 441 that occupies most of the center volume of the drift tube 409. In this example, an electron beam 441 shown in FIG. 6 occupies the volume between the center of the drift tube to about 60% of the inner radius of the drift tube. Thus, the hollow electron beam 443 is much thinner than the solid electron beam 441 and occupies a completely different region of the drift tube 409.

Different types of magnetic fields can be applied to the drift tubes depending upon the type of electron beam being used. A solid electron beam can be focused by a constant magnetic field or a periodic permanent magnet (PPM) field. In contrast, a hollow electron beam can only be focused by a constant magnetic field. The electric fields emanating from the individual cavities comprising the klystron interaction circuit can be simulated using the code, SUPERFISH, that is available without charge from the Los Alamos National Laboratory, Los Alamos, N.M. These electric fields, calculated in matrix form as functions of N iterations along the axis and M iterations for variations in radius, are tabulated and inserted directly into a klystron large signal code called KLSC where specific critical parameters such as efficiency and saturated gain can be determined.

Figure 7:
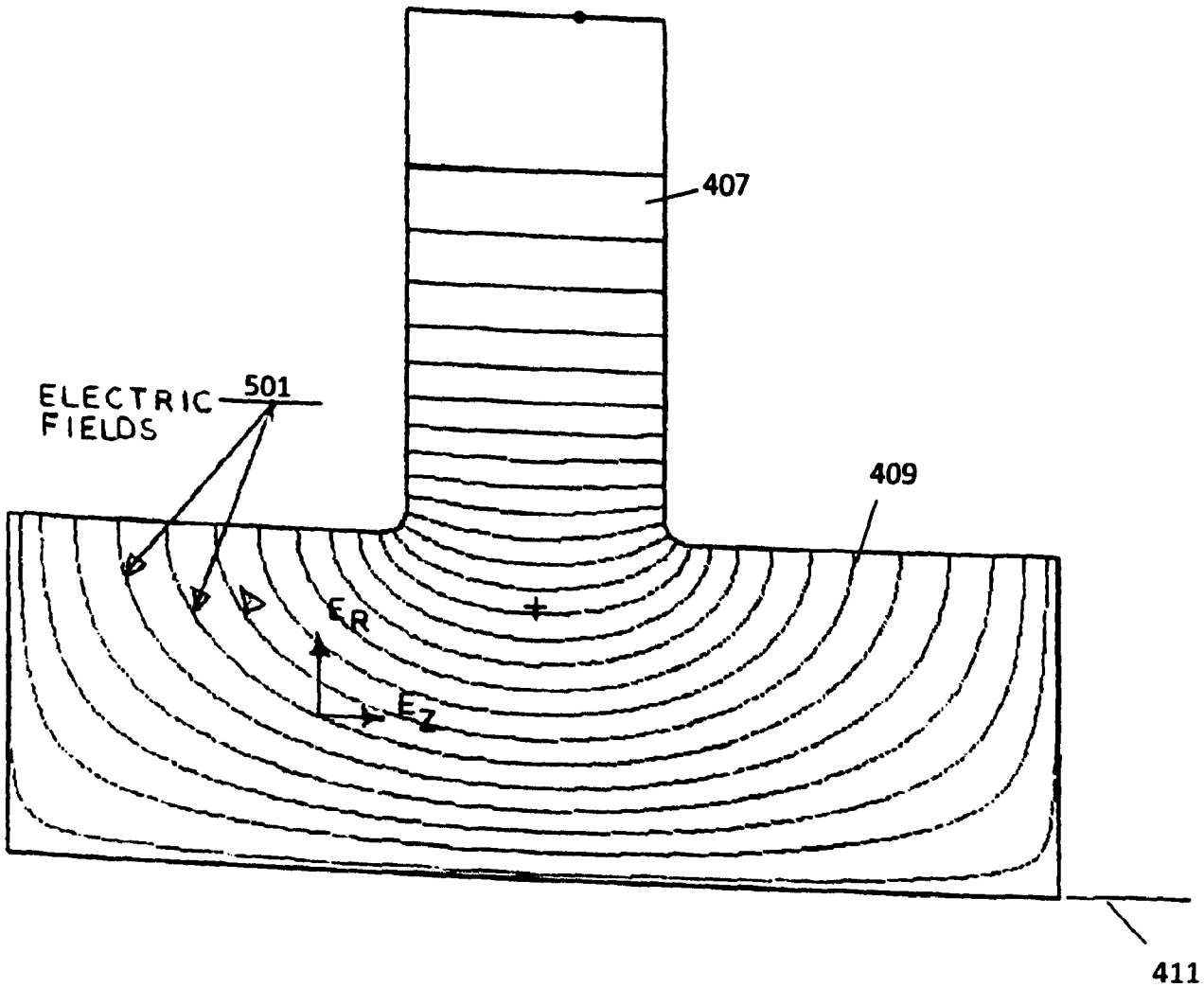
FIG. 7 is a half sectional view of the cavity and drift tubes from FIG. 6 where the oscillating axial electric field, $E_z$ and the radial electric field, $E_r$ are designated.

With reference to FIG. 7, a half sectional view of a drift tube 409 and cavity 407 with the electric field lines 501 is illustrated with the axis 411 representing the center of the drift tube 409. The electric field lines 501 can be separated into an axial component $E_z$ in the axial direction of the drift tube 409 and a radial component $E_r$ in the radial direction perpendicular to the axis of the drift tubes 409.

While the functions of both solid electron beam and hollow electron beam klystrons are similar, there are substantial benefits to using a hollow electron beam. A beam parameter called "perveance" is denoted by K in the formula: $K=31.62\times I/V^{3/2}$, where I is the beam current in amperes and V is the beam voltage in kilovolts. Klystrons that employ solid electron beams will normally exhibit a higher efficiency as the K decreases and a lower efficiency as the K increases. A solid electron beam klystron, in general, may have a K=0.5 microperv, if high efficiency is desired, however, this low K results in a larger beam voltage and consequently a longer interaction circuit. If efficiency is not important but more bandwidth and lower beam voltage are desirable, K may be as high as 2.0 micropervs which results in a lower beam voltage and a shorter interaction circuit. In contrast, the hollow beam klystron does not show this strong dependence between efficiency and perveance. The efficiency of the hollow electron beam is not significantly reduced by a high perveance because the thin wall thickness of the hollow beam does not experience strong radial modulation from the electric fields in the klystron and almost all of the modulation is in the axial direction. Thus, hollow electron beams can operate at high values of perveance without sacrificing efficiency. This is particularly beneficial because the hollow electron beam can operate at a reduced voltage and a much shorter interaction circuit while still maintaining a high efficiency in spite of having a perveance in the range of 3-5 micropervs.

To illustrate the benefits of the hollow beam klystron, a multi-megawatt klystron with a solid electron beam can be directly compared to an equivalent hollow beam klystron operating at the same frequency. The operating conditions and differences between the hollow beam and solid beam klystron are summarized in Table 1 below.

TABLE 1

| Parameter | Solid Electron Beam | Hollow Electron Beam |
|---|---|---|
| RF Power Output | 9.2 MW | 10.6 MW |
| Beam Perveance | 0.9 micropervs | 3.4 micropervs |
| Beam Voltage | 195 kV | 120 kV |

TABLE 1-continued

| Parameter | Solid Electron Beam | Hollow Electron Beam |
|---|---|---|
| Beam Current | 77.5 A | 140.0 A |
| Circuit Length | 1.4 meters | 0.97 meters |
| Efficiency | 61% | 63% |
| Variation in $E_r$ across beam width | 11.0:1 | 1.095:1 |

Based upon these operating conditions, the equivalent hollow electron beam klystron has a voltage that is 61% of the solid electron beam klystron. The lower beam voltage for the hollow electron beam klystron substantially reduces the possibility of RF arcing which can damage the electron gun and klystron. The hollow electron beam klystron also has a length that is 69% of the solid electron beam klystron. The reduction in length reduces the fabrication costs of the klystron and simplifies the installation.

In addition to the reduced electron beam voltage and circuit length, the hollow electron beam is also substantially more stable within the klystron than a solid electron beam. In the hollow beam example described above, the variation in $E_r$ between the inner diameter and the outer diameter of the beam is about 1.095:1 through the length of the klystron. Since the variation in the radial electric field $E_r$ is fairly small, the radial movement of the electrons and expansion of the hollow electron beam diameter as it passes through the klystron is minimal.

Figure 8:
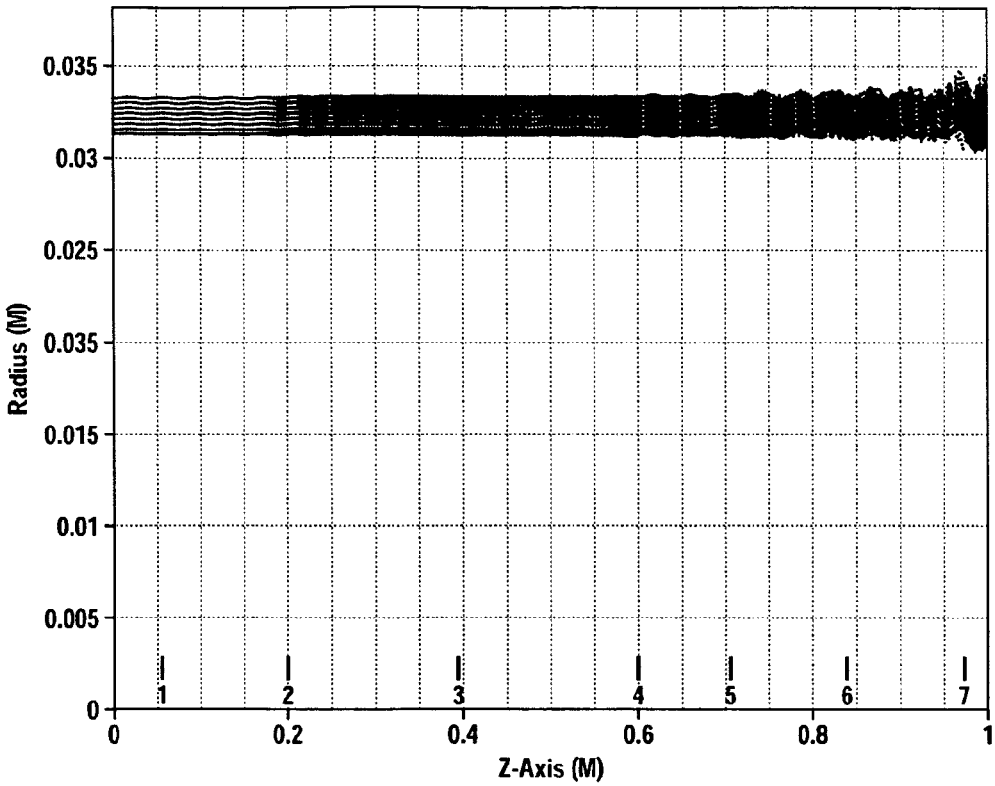
FIG. 8 is a plot of axial movement of a hollow electron beam through the seven cavities as a function of the radius of the drift tube.

For the hollow beam klystron from Table 1, FIG. 8 illustrates the hollow electron beam composed of 8 concentric rings as the beam traverses axially the seven cavities, so designated. The vertical axis is the varying radius of the drift tube connecting the individual cavities where the maximum radius is the radius of the drift tube. Note the almost absence of radial displacement of the hollow electron beam. This low level of radial displacement is due to the small variation of the radial electric field, $E_r$ across the electron beam.

Figure 9:
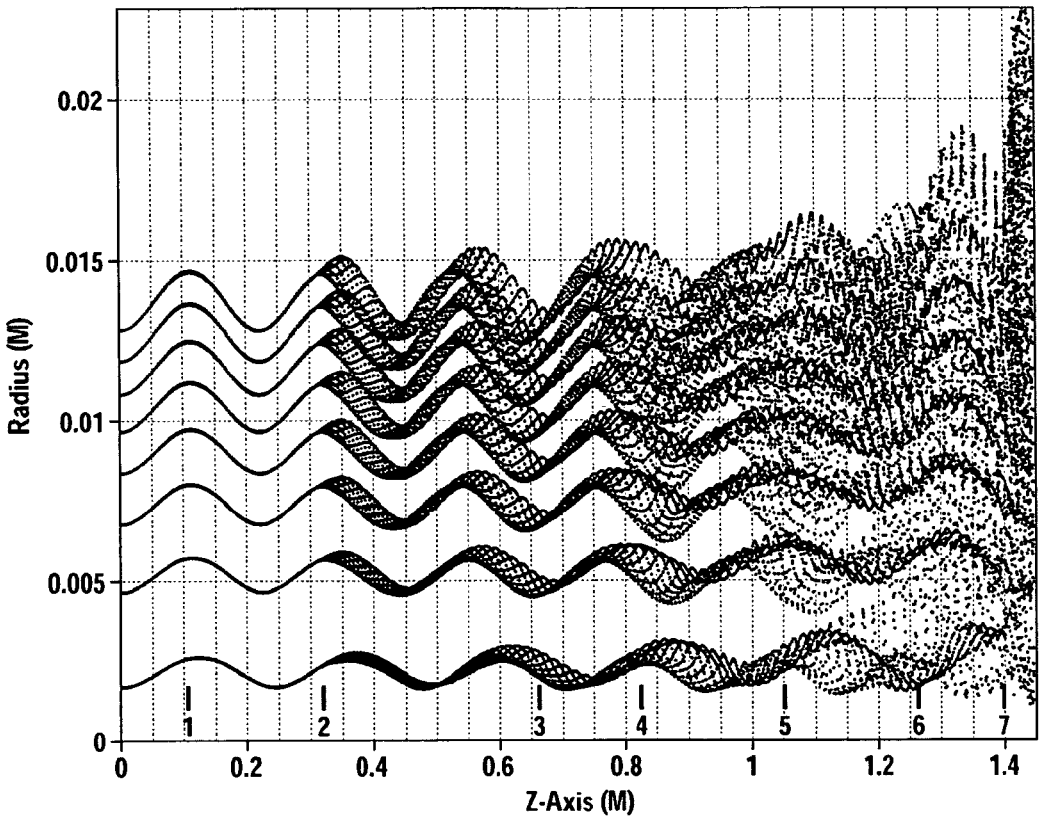
FIG. 9 is a plot of the axial movement of a solid electron beam through the seven cavities as a function of the radius of the drift tube.

For comparison, for the solid beam electron klystron from Table 1, FIG. 9 illustrates the solid electron beam composed of 8 concentric rings each represented by line as the beam traverses axially the seven cavities. The vertical axis is the radius in the drift tube connecting the individual cavities where the maximum radius is the inner radius of the drift tube. Note the large variation in radial displacement of the individual rings as the radius increases and as the beam traverses the seven cavity circuit. This large radial displacement is due mainly to the large variation in $E_r$ of about 11:1 from the axis of the cavity to the 0.6×the radius of the drift tube. At the last cavity, i.e., cavity number 7 where the RF power is extracted, the radius of the composite electronic beam exceeds the radius of the drift tube. That is, the beam is intercepted by the drift tube.

It will be understood that the inventive system has been described with reference to particular embodiments, however additions, deletions and changes could be made to these embodiments without departing from the scope of the inventive system. Although the hollow beam electron guns and klystrons that have been described include various components, it is well understood that these components and the described configuration can be modified and rearranged in various other configurations.

What is claimed is:

1. A hollow beam electron gun having a center axis comprising:

an annular cathode having an annular electron emitting surface that is perpendicular to the center axis and defined by an inner radius and an outer radius about the center axis;

a first focusing electrode mounted within the inner radius of the circular electron emitting surface;

a second focusing electrode mounted outside the outer radius of the circular electron emitting surface;

an annular anode that has an inner surface that is defined by an inner radius about the center axis;

wherein the electron emitting surface is substantially planar, the length of the inner radius of the inner surface of the anode is larger than the length of the outer radius of the circular electron emitting surface and the anode is mounted distally of the cathode.

2. The hollow beam electron gun of claim 1 wherein the length of the inner radius of the circular electron emitting surface is greater than 50% of the length of the inner radius of the anode.

3. The hollow beam electron gun of claim 1 wherein the length of the outer radius of the circular electron emitting surface is greater than 80% of the length of the inner radius of the anode.

4. The hollow beam electron gun of claim 1 wherein the length of the outer radius of the circular electron emitting surface is less than 95% of the length of the inner radius of the anode and an inner radius of the circular electron emitting surface is greater than 75% of the inner radius of the anode.

5. The hollow beam electron gun of claim 1 wherein the width of the circular electron emitting surface is less than 20% of the length of the inner radius of the anode.

6. A hollow beam klystron having a center axis comprising:

a hollow beam electron gun coupled to a proximal portion of the klystron comprising: (i) an annular cathode having an annular electron emitting surface that is perpendicular to the center axis and defined by an inner radius and an outer radius about the center axis, (ii) an anode, (iii) a first focusing electrode mounted within the inner radius of the circular electron emitting surface, and (iv) a second focusing electrode mounted outside the outer radius of the circular electron emitting surface;

a plurality of drift tubes that have inner surfaces that are defined by an inner radius about the center axis and extend from the proximal portion to a distal portion of the klystron;

a solenoid providing a magnetic field for focusing the electron beam; an RF input coupled to the proximal portion of the klystron; and an RF output coupled to the distal portion of the klystron.

7. The hollow beam klystron of claim 6 wherein the length of the inner radius of the electron emitting surface is greater than 50% of the length of the inner radius of the drift tubes.

8. The hollow beam klystron of claim 6 wherein the length of the outer radius of the electron emitting surface is greater than 80% of the length of the inner radius of the drift tubes.

9. The hollow beam klystron of claim 6 wherein the length of the outer radius of the electron emitting surface is less than 95% of the length of the inner radius of the drift tubes and the inner radius of the circular electron emitting surface is greater than 75% of the length of the inner radius of the drift tubes.

10. The hollow beam klystron of claim 6 wherein the width of the circular electron emitting surface is less than 20% of the length of the inner radius of the drift tubes.

11. A method for operating a klystron comprising:

providing: (i) a hollow beam electron gun having: a cathode having an annular electron emitting surface that is perpendicular to a center axis of the electron gun and an anode; (ii) a plurality of aligned drift tubes that extend from the electron gun to a distal portion of the klystron; (iii) a solenoid that surround the drift tubes and generate magnetic fields within the drift tubes, and (iv) an RF input and an RF output;

applying a voltage (V) and a current (I) to the hollow beam electron gun; and emitting a hollow electron beam from the circular electron emitting surface of the cathode through the drift tubes towards a distal portion of the klystron;

wherein the perveance=$31.62 \times I/V^{3/2} > 2.0$.

12. The method of claim 11 wherein an outer radius of the hollow electron beam expands less than 20% from the circular electron emitting surface of the cathode to the distal portion of the klystron.

13. The method of claim 11 wherein the hollow electron beam travels through a radial region of the drift tubes cross section that is greater than 75% of the inner radius of the drift tubes.

14. The method of claim 13 wherein the hollow electron beam travels through the radial region of the drift tubes that is less than 95% of the inner radius of the drift tubes.

15. The method of claim 11 wherein the electron gun includes a first focusing electrode mounted within the inner radius of the circular electron emitting surface and a second focusing electrode mounted outside the outer radius of the circular electron emitting surface that provide a uniform cathode current density in the hollow electron beam.

16. The method of claim 15 wherein the hollow beam electron gun includes a heater that heats the cathode to thermionic emission of electrons.

17. The method of claim 16 wherein the hollow beam electron gun operates in a space-charge limited region and emits a continuous stream of electrons.

18. The method of claim 11 wherein the beam voltage (V) is less than 130 kV and the beam current (I) is greater than 100 A and the klystron produces an RF output power greater than 10 MW.

19. The method of claim 11 wherein the beam voltage (V) is less than 50 kV and the beam current (I) is greater than 25 A and the klystron produces an RF output power greater than 500 kW.

* * * * *